US009196231B2

(12) United States Patent
McClary

(10) Patent No.: US 9,196,231 B2
(45) Date of Patent: Nov. 24, 2015

(54) CAPO FOR A DOBRO, SLIDE GUITAR, HAWAIIAN GUITAR, OR SIMILAR RAISED STRING INSTRUMENT

(71) Applicant: Charles Forrest McClary, Magnolia Springs, AL (US)

(72) Inventor: Charles Forrest McClary, Magnolia Springs, AL (US)

( * ) Notice: Subject to any disclaimer, the term of this patent is extended or adjusted under 35 U.S.C. 154(b) by 0 days.

(21) Appl. No.: 14/201,894

(22) Filed: Mar. 9, 2014

(65) Prior Publication Data

US 2015/0255049 A1 Sep. 10, 2015

(51) Int. Cl.
*G10D 3/04* (2006.01)

(52) U.S. Cl.
CPC ..... *G10D 3/043* (2013.01)

(58) Field of Classification Search
CPC ..... G10D 3/043; G10D 3/14; G10D 3/00; G10D 3/143; G10D 3/04; G10H 1/44
USPC ..... 84/312 R, 318
See application file for complete search history.

(56) References Cited

U.S. PATENT DOCUMENTS 4,252,046 A * 2/1981 Myerson et al. ..... 84/318

* cited by examiner

*Primary Examiner* — Kimberly Lockett
(74) *Attorney, Agent, or Firm* — George L Williamson

(57) ABSTRACT

A capo for an instrument having a plurality of strings elevated above a fretboard such as a dobro, slide guitar, Hawaiian guitar, or similar raised stringed instrument. This capo uses a sliding wedge adjuster that is installed in the upper milled slot of bar member. The sliding link assembly is installed thru the sliding wedge adjuster slot, into the hole in the center of bar member aligned properly. The string tension bar is installed in sliding link assembly hole and cushion tubes are installed on tension rod, each side of sliding link assembly. The sliding wedge adjuster raises the sliding link assembly as sliding wedge adjuster is pushed inward into bar member. This action compresses the strings to bottom of bar member. This sliding wedge function is unique to this improved capo.

4 Claims, 9 Drawing Sheets

TYPICAL 2

CAPO FOR A DOBRO, SLIDE GUITAR, HAWAIIAN GUITAR, OR SIMILAR RAISED STRING INSTRUMENT

CROSS-REFERENCE TO RELATED APPLICATIONS

U.S. Pat. No. 7,390,948 B2;
Date: Jun. 24, 2008;
Bruce Walworth

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

1. Field of the Invention

The purpose of a Resophonic Guitar Capo and other raised string instrument capos is to change the key the instrument is to be played in. This key change is accomplished by, in effect, shortening the string length on resophonic guitars and other raised stringed instruments. This shortening of the strings is accomplished by compressing the strings of the instrument to a bar at various positions along the instrument neck. Existing designs of capos for Resophonic Guitars tend to require several adjustments and possible use of both hands to install and make these adjustments.

2. Description of the Prior Art

U.S. Pat. No. 4,252,046 issued to Myerson et al. and publication date of Feb. 24, 1981 describes a capo shown in FIG. 1. This capo uses a pressure bar with an elastic strap to clamp instrument strings downward against the instrument's fretboard to shorten the strings. Due to this downward clamping action, the Myerson capo will not work with a raised string instrument such as a dobro.

FIG. 2 shows the Liberty Capo dating from early 1980's using a lever to clamp the strings upward against a bar to cause the effect of shortening the strings. This capo has no pressure adjustment.

U.S. patent #2007017531 issued to Bruce Walworth and publication date of Aug. 2, 2007 is shown in FIG. 3. This capo has a lever action requiring a tool for pressure adjustment.

BRIEF SUMMARY OF THE INVENTION

FIG. 4 illustrates how the capo is assembled as a unit, and how the capo mounts to strings of instrument. FIG. 5 thru FIG. 9 show the individual parts of the capo.

In contrast to previous designs of capos for a Resophonic Guitars and other raised stringed instruments that use a lever to operate. This capo uses a sliding wedge adjuster allowing infinite one-handed adjustment of the pressure of strings against the bar member without using any tools or other secondary adjusting mechanisms.

DETAILED DESCRIPTION OF THE INVENTION

Figure 1:
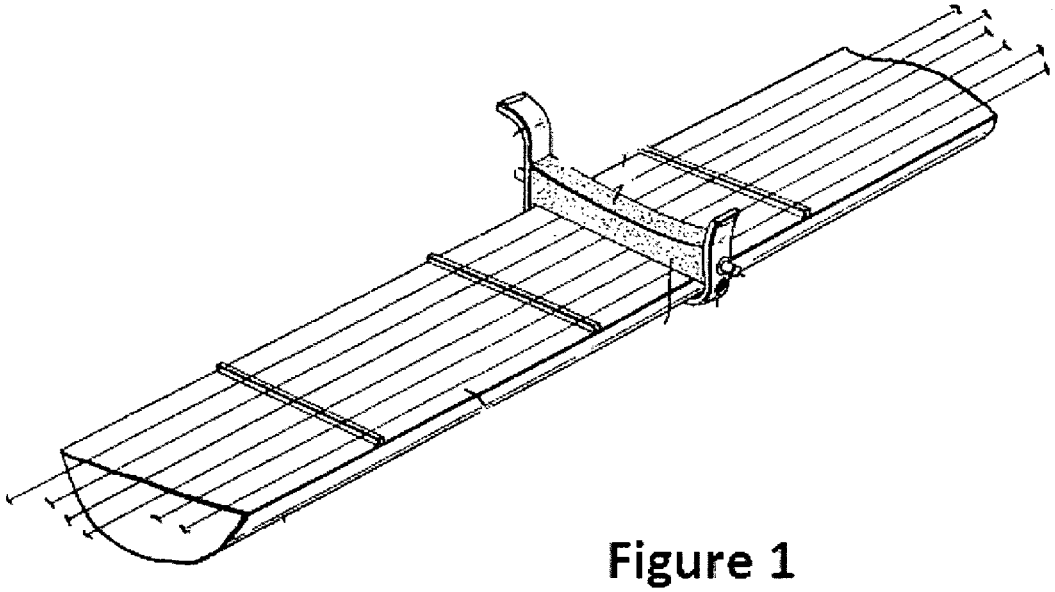
Figure 1 (Prior Art)
FIG. 1: is an image taken from the Myerson capo U.S. Pat. No. 4,252,046.
Figure 2:
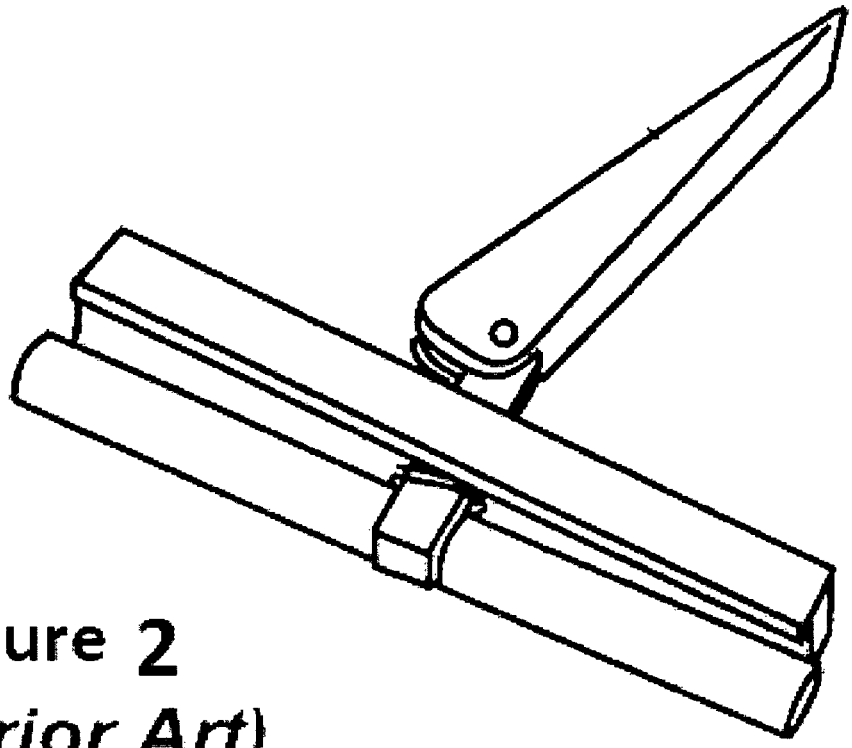
Figure 2 (Prior Art)
FIG. 2: is a drawing of a lever-operated Liberty capo, from the early 1980s.
Figure 3:
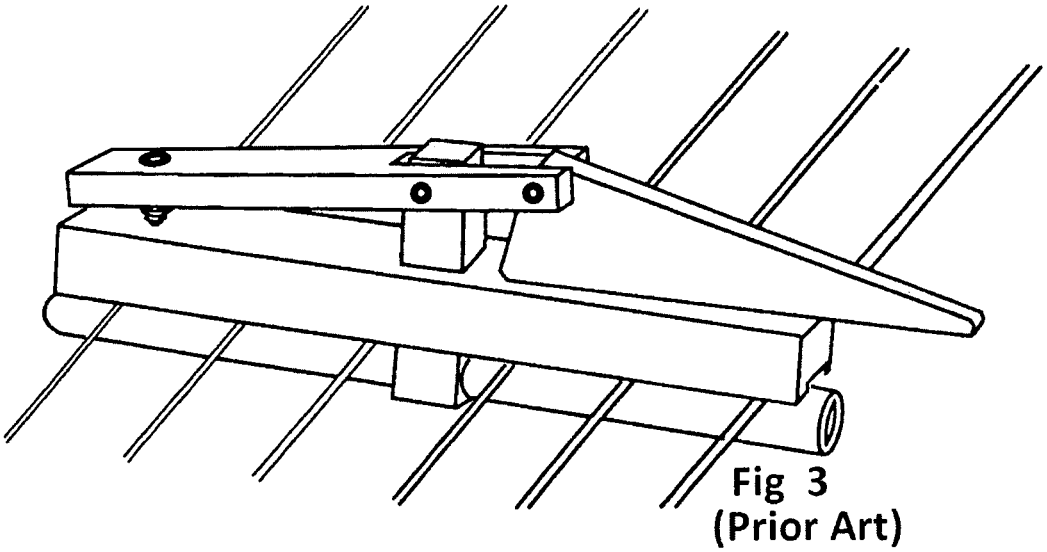
Fig 3 (Prior Art)
FIG. 3: is an image taken from Walworth capo U.S. Pat. No. 7,390,948.
Figure 4:
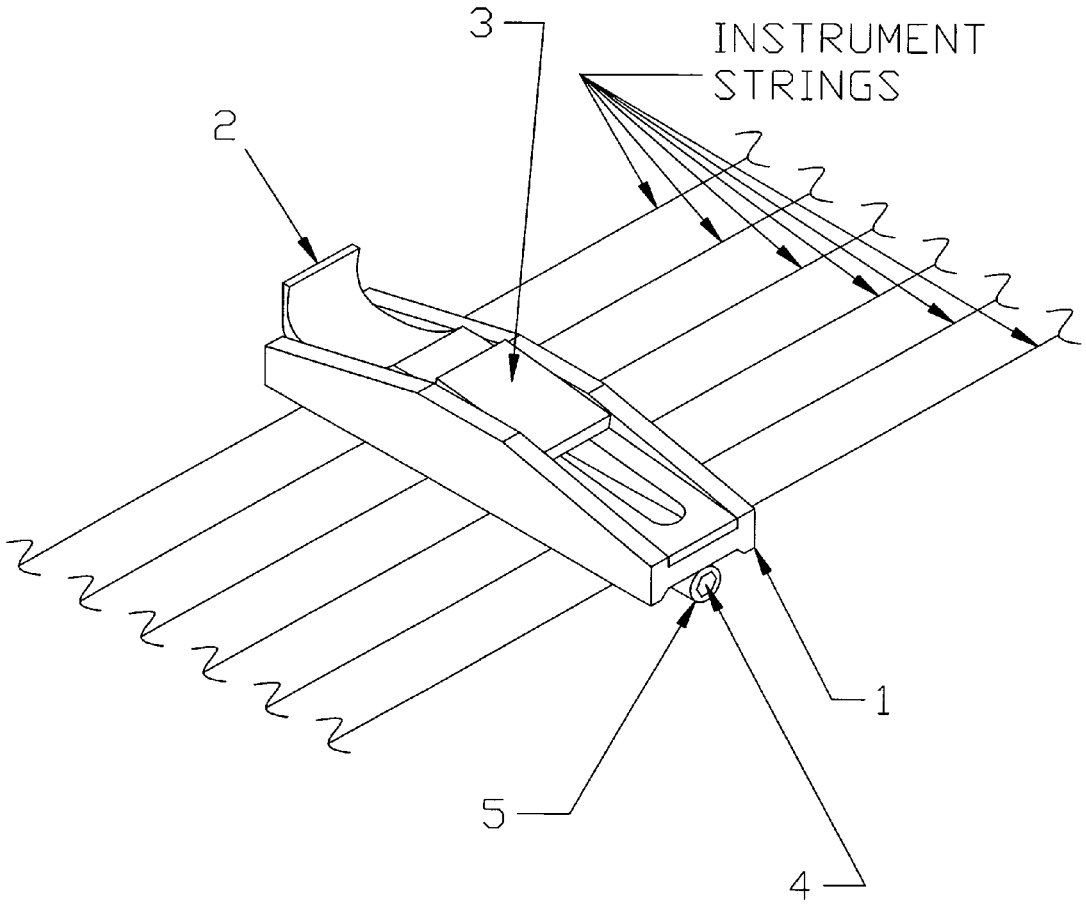
FIG. 4: detailed assembly drawing of complete capo with capo mounted on instrument strings.

1. FIG. 4 shows the fully assembled capo mounted on strings of instrument. The capo is shown in isometric view mounted on to strings of a typical musical instrument. This drawing shows each part in relation to the assembled capo. The capo is assembled by inserting the sliding wedge adjuster 2 into top milled slot of the bar member 1. The sliding link assembly 3 is inserted down thru center hole of bar member 1. The sliding link assembly alignment cap must be aligned with milled slot. From bottom side of bar member 1 the clamping member 4 is inserted thru hole in protruding sliding link assembly 3. The compressible resilient sleeve 5 is now installed over the clamping member 3 with clamping member 4 centered on sliding link assembly 3. The compressible resilient sleeve 5 provides a cushion for strings of instrument.

To install capo on instrument strings, grasp capo's bar member 1 by sides with thumb and fingers. Tilt bar member 1 so sliding wedge adjuster 2 slides out allowing sliding link member assembly 3 to drop downward to provide sufficient clearance for strings. Place pointer finger on sliding link assembly 3 to hold down. Rotate capo parallel with strings of instrument, insert clamping member 4 into the middle space between the strings of instrument. Set capo on strings of instrument, rotate 90°, and press sliding wedge adjuster 2 inward to lock capo in position, compressing strings of instrument between compression resilient sleeve 5 and bar member 1.

Figure 5:
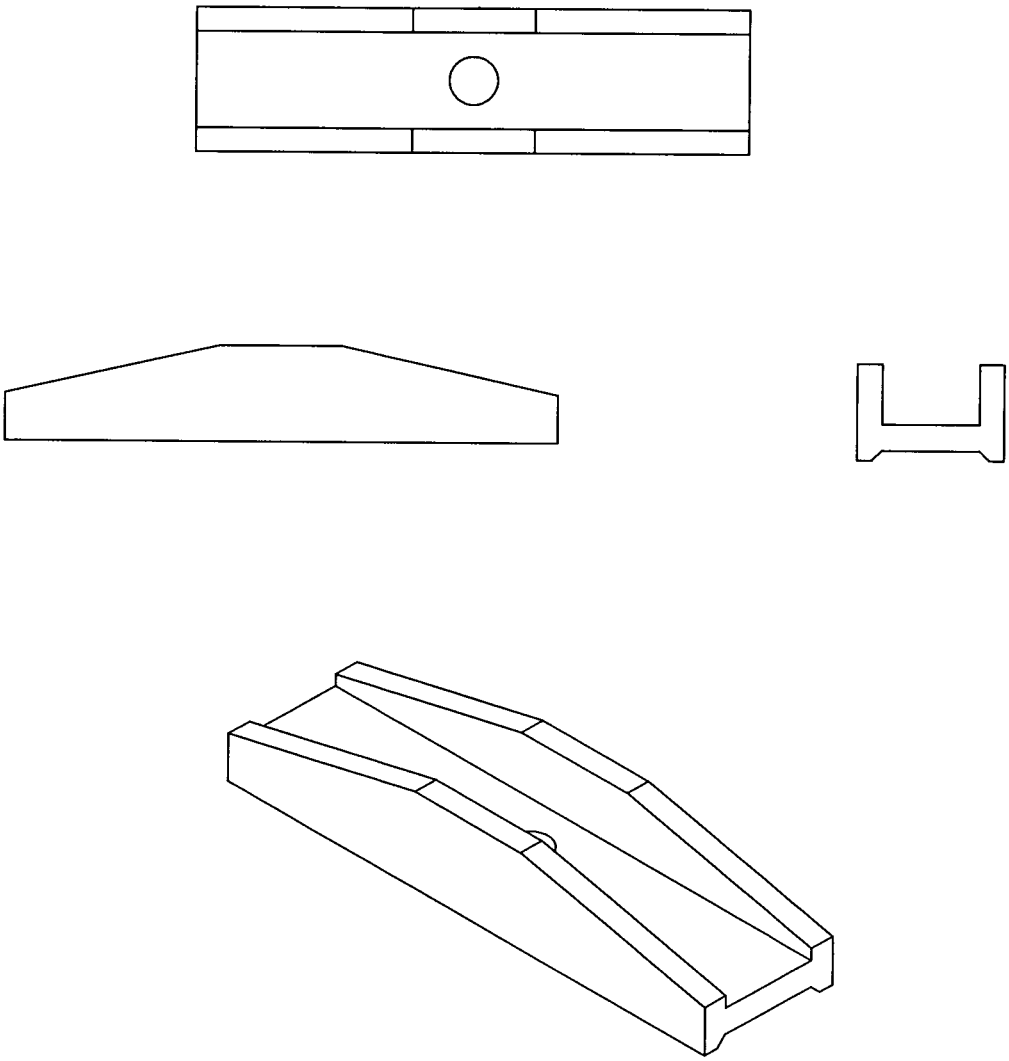
FIG. 5; detailed drawing of the bar member.

FIG. 5 shows the bar member 1. This bar member is a block of steel or other type of hard metal approximately ½" high by 1" wide, and 3" long. The top milled slot is ½" wide by 0.300" deep. The bottom slot is 0.050" deep with side walls beveled inward 45°. A ¼ hole is drilled in center of bar for sliding link assembly. The top sides of bar are tapered downward toward each end for cosmetic and ease of use. All dimensions are approximate to provide for clearance fit.

Figure 6:
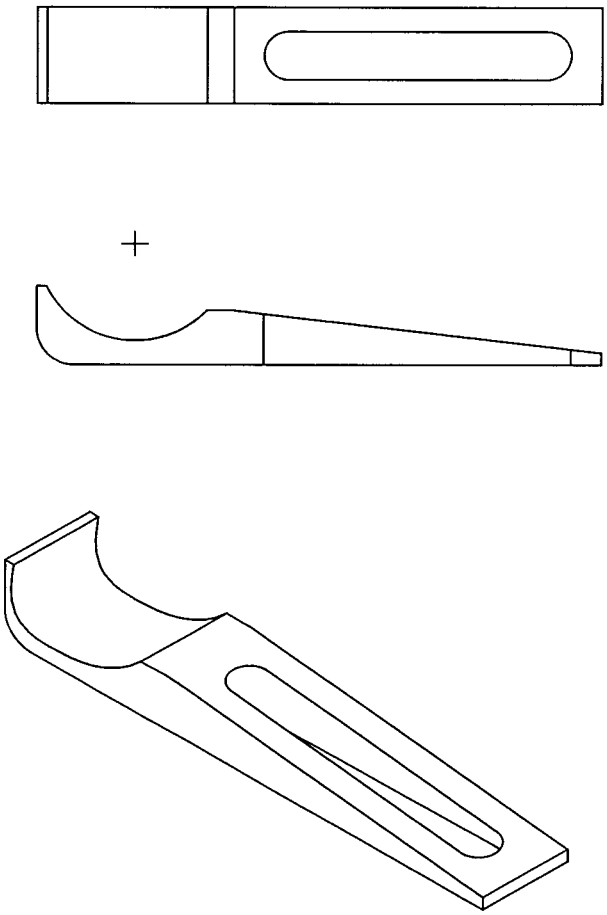
FIG. 6; detailed drawing of the sliding wedge adjuster.

FIG. 6 shows the sliding wedge adjuster 2. This sliding wedge is a block of steel or other type of hard metal approximately ½" wide by ⅜" high, and 3" long. This block of metal tapers from ⅜" at one end to 1/32" on other end. A slot ¼ wide is centered in the wedge. The slot starts 3/16" from low end and extends to 1⅛" from high end. There is a thumb notch milled in the high end to disengage capo from strings. All dimensions are approximate to provide for clearance fit.

Figure 7:
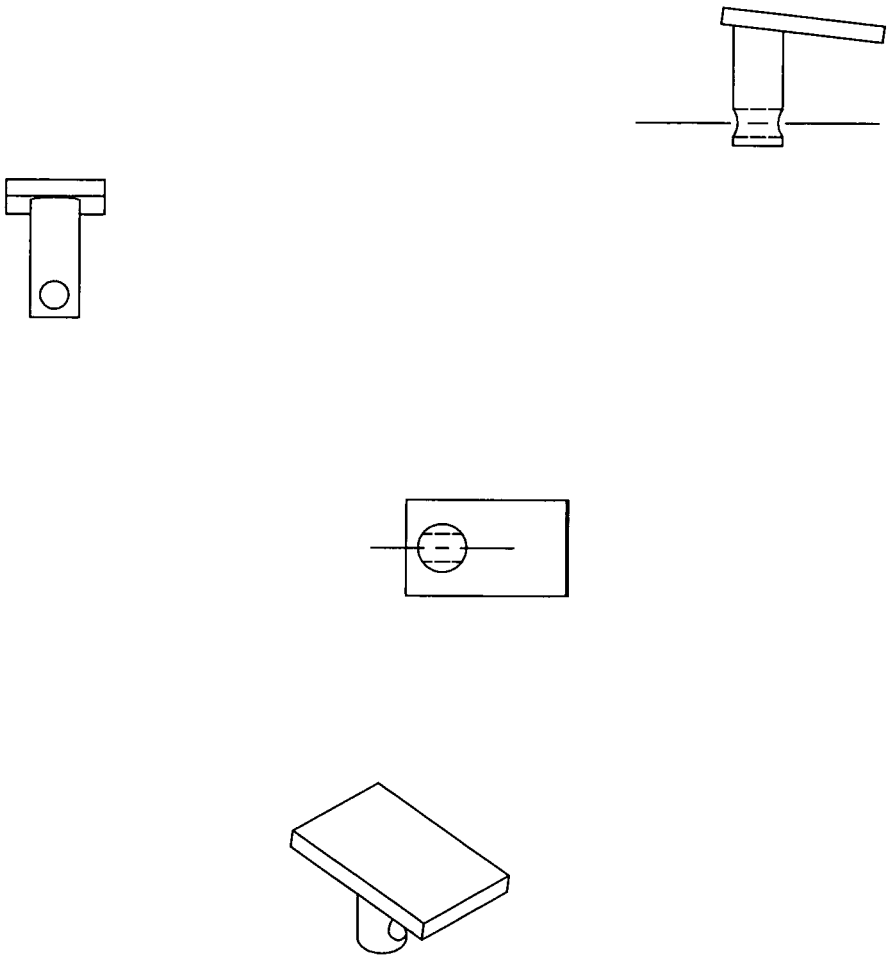
FIG. 7; detailed drawing of the sliding link assembly.

FIG. 7 shows the sliding link assembly 3. The sliding link assembly 3 consists of a ¼" diameter by ¾" long rod with a ⅛" hole ⅛" from one end. The sliding link assembly 3 alignment cap is made of ½" wide by ¾" long by 1/16" thick steel or other type of hard metal welded to top of sliding link assembly pin at proper angle to match sliding wedge adjuster angle. The sliding link assembly pin hole must be aligned with cap in order for string tension rod to be aligned properly with main bar. All dimensions are approximate to provide for clearance fit.

Figure 8:
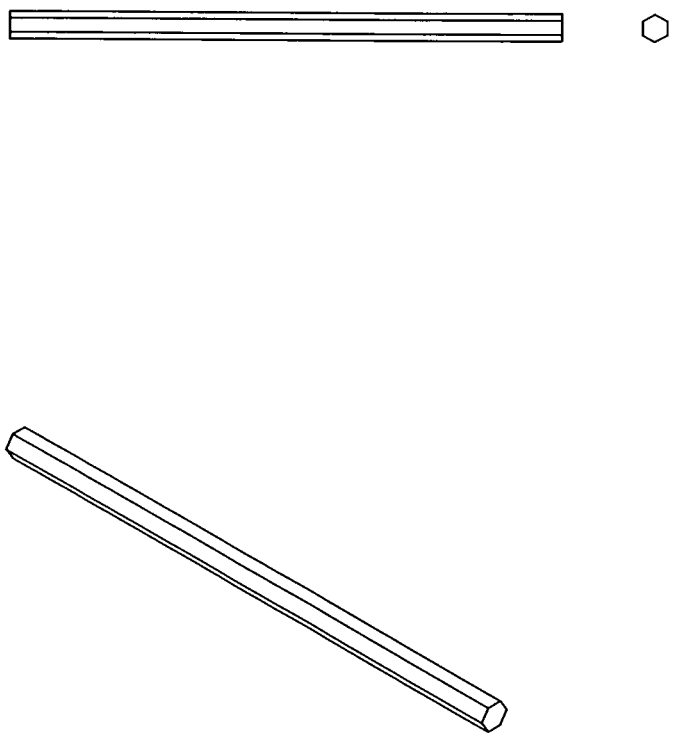
FIG. 8; detailed drawing of the clamping member.

FIG. 8 shows the string tension rod. The string tension rod is made from ⅛" hardened steel rod 3" long.

Figure 9:
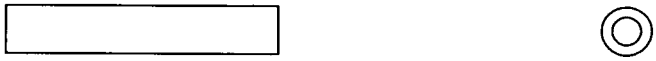
FIG. 9; detailed drawing of the compressible resilient sleeve. There are two compressible resilient sleeves, one mounted on each side of sliding link assembly on the clamping member.
Figure 9:
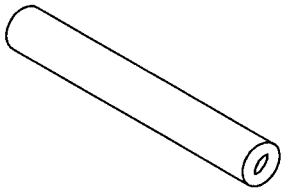

FIG. 9 shows the compressible resilient sleeve of which there are two identical parts. These are ⅛" ID, ¼ OD rubber type tubes that are 1¼" long each.

What is claimed:

1. A capo for a stringed instrument having raised strings, comprising:

(a) a main bar, said main bar having a top milled slot therein and a rust hole therein;

(b) a sliding wedge disposed within said main bar, said sliding wedge having an upper sloped surface and a slot therein;

(c) a first rod, said first rod having a cap disposed on an upper end thereof, said first rod having a second hole therein;

(d) wherein a lower surface of said cap rests on said upper sloped surface of said sliding wedge and said first rod extends downwardly through said slot of said sliding wedge and said first hole of said main bar;

(e) a string tension rod extending through said second hole of said first rod underneath said main bar; and, (f) said sliding wedge being slidable between outward and inward positions to raise and lower said cap riding on said upper sloped surface of said sliding wedge to raise and lower said string tension rod for compressing the strings between said string tension rod and a lower surface of said main bar when said sliding wedge is in said inward position.

2. The capo of claim 1, wherein said slot extends longitudinally along said sliding wedge.

3. The capo of claim 1, further comprising a thumb notch being disposed on an end of said sliding wedge.

4. The capo of claim 1, further comprising a cushion tube being disposed on said string tension rod.

* * * * *